US011027752B2

(12) United States Patent
Weber et al.

(10) Patent No.: US 11,027,752 B2
(45) Date of Patent: Jun. 8, 2021

(54) RAILWAY FACILITY WITH HIGH THROUGHPUT LOOP TRACK

(71) Applicant: HDR, Inc., Omaha, NE (US)

(72) Inventors: Paul J. Weber, Spokane, WA (US); Kurt W. Reichelt, Portland, OR (US)

(73) Assignee: HDR, Inc., Omaha, NE (US)

( * ) Notice: Subject to any disclaimer, the term of this patent is extended or adjusted under 35 U.S.C. 154(b) by 175 days.

(21) Appl. No.: 15/915,923

(22) Filed: Mar. 8, 2018

(65) Prior Publication Data

US 2018/0257670 A1 Sep. 13, 2018

Related U.S. Application Data

(60) Provisional application No. 62/469,794, filed on Mar. 10, 2017.

(51) Int. Cl.
*B61B 1/00* (2006.01)

(52) U.S. Cl.
CPC ..... *B61B 1/005* (2013.01)

(58) Field of Classification Search
CPC ... B61L 17/00; B61B 1/00; B61B 1/02; B61B 1/005
See application file for complete search history.

(56) References Cited

U.S. PATENT DOCUMENTS 1,387,863 A 8/1921 Otis
3,091,188 A 5/1963 Graham
3,700,128 A 10/1972 Noble et al.
3,889,603 A * 6/1975 Harada ..... B61B 1/005 104/26.1
5,492,290 A 2/1996 Quinn et al.
6,418,854 B1 7/2002 Kraft
6,439,128 B1 8/2002 Miller et al.
(Continued)

FOREIGN PATENT DOCUMENTS

DE 3926205 A1 4/1990
FR 2388707 A1 11/1978
WO 2008106703 A1 9/2008

OTHER PUBLICATIONS

Reverse Loops Part 3, retrieved on Apr. 30, 2017 from http://www.gaugemaster.com/articles/guides/Reverse-Loops-part3.html.
(Continued)

*Primary Examiner* — Robert J McCarry, Jr.
(74) *Attorney, Agent, or Firm* — Erickson Kernell IP, LLC; Mark C. Young

(57) ABSTRACT

A railway facility with high throughput loop track includes a series of adjacent parallel staging tracks connected to a main line to receive and depart trains, arranged in a path so that trains transverse around the railway facility. A balloon loop track, which includes a loading or unloading facility, is connected to the staging tracks loops and reverses the direction of the train so that upon completion of loading or unloading a train can depart or be re-staged without requiring repositioning or turning of locomotives. Staging tracks are included for staging both arriving and departing trains. In alternative embodiments transload tracks and at-grade access roads allow storage and retrieval of cargo to interior space within the staging tracks, and an escape track allows expedited exit of trains from the balloon loop track.

13 Claims, 10 Drawing Sheets

(56) References Cited

U.S. PATENT DOCUMENTS

| | | | |
|---|---|---|---|
| 8,649,916 | B2 | 2/2014 | Woo et al. |
| 2013/0213254 | A1 | 8/2013 | Dai |
| 2014/0081486 | A1 | 3/2014 | Palanti et al. |

OTHER PUBLICATIONS

Cke1st's Trackplans Page, retrieved on Apr. 30, 2017 from http://www.cke1st.com/m_train2.htm.

* cited by examiner

RAILWAY FACILITY WITH HIGH THROUGHPUT LOOP TRACK

CROSS-REFERENCE TO RELATED APPLICATIONS

This application claims the benefit of U.S. Provisional Patent Application No. 62/469,794, filed Mar. 10, 2017, the disclosure of which is hereby incorporated herein in its entirety by reference.

BACKGROUND

Railway transport continues to be a primary mode of conveying commodities and other goods throughout the United States and other countries of the world. In the U.S. alone, billions of tons of goods and products are moved via railway every year, with rail yards located in virtually every state providing hundreds of hubs for loading and unloading railway transported commodity products for further distribution. Commodity products such as coal, grain, sulphur, potash, crude oil, and the like, as well as intermodal transport containers holding various goods, are regularly transported by railway between various origins and destinations.

Because of the costs and time incurred in breaking up trains to move cars between trains, most commodity and goods transporting trains in operation today are either unit trains—i.e. trains dedicated to transporting a single commodity between a single origin and destination on behalf of a single shipper—or are intermodal trains—i.e., trains dedicated to the transport of intermodal storage containers, having one or more products enclosed, the containers all having a common origin and destination. Intermodal containers are configured to be transported by multiple modes of transportation (e.g., rail, ship, and truck) without any handling of the contained freight itself when changing modes.

Unit trains thus allow railroad companies and shippers of goods to minimize transportation costs as compared to operating trains comprised of disparate cars aggregated from multiple shippers moving between multiple origins and destinations, while intermodal trains minimize costs as compared to shipping via truck from origin to destination.

In addition to the configuration of the trains themselves, the minimization of time and cost in loading and unloading trains is dependent on the configuration of the loading and unloading facilities accepting those trains. In order to receive, load, unload, inspect, and depart a unit train efficiently, the loading and unloading facilities must be able to accommodate entire unit trains, and allow the trains (including the locomotives) to remain intact, or in as large of segments of railcars as possible, as they negotiate through the facility, and such that the trains do not block the railroad's main line or inhibit movement of trains on the main line. In many cases the railroad provides financial incentives to shippers in the form of decreased transportation costs in order to encourage the use of unit trains and facilities which minimize load, unload, and travel time and maximize utilization of railcars.

Similarly, facilities to efficiently accommodate intermodal trains and allow the trains to remain intact or in as large of segments of railcars as possible as they travel through the facility and loading and unloading tracks, without blocking or inhibiting movement of trains on the main line are likewise desirable.

Railroads have also required shippers and receivers, or other operators of unit train loading and unloading facilities, to install and use loop tracks at origin and destination facilities. Loop tracks are comprised of track arranged in an elongated circle shape, with the length of the track sufficient to accommodate an entire, intact, unit train. A throat area comprising numerous crossover tracks link the main line to the loop track, allowing arriving trains to transition from the main line to the loop track and allowing departing trains to transition from the loop track to the main line.

Thus, in typical unit train operation, an arriving unit track leaves the main track via one of the crossover tracks in the throat and enters the loop track, following the loop track around its length. With a sufficiently sized loop track, by the time the head end of the train has returned to the throat the rear of the train has cleared the throat so that the entire train is contained on the loop track.

At one or more points along the loop track, unit train loading and/or unloading facilities are positioned alongside the loop track to allow commodities to be loaded or unloaded to or from the train cars. In typical operation, a bulk commodity train pulls from a loop track, slowly past the loading or unloading facility, either in continuous slow motion or in start-stop increments sequentially moving the train back into the same, or different, loop track, until the entire train is loaded or unloaded. Upon completion of the loading or unloading the train departs the loop track via a crossover track in the throat and is directed back to the main line, typically in the reverse direction from which it entered the loop track.

While current unit train loop track designs generally serve their intended purpose of accommodating a single intact unit train without inhibiting the main line, the current design is not without numerous drawbacks. For example, because many shippers' and receivers' production facilities, mines, refineries, and ports are of large size, those facilities themselves can potentially serve multiple unit trains simultaneously and potentially achieve a higher throughput by doing so. However, current loop track designs cannot efficiently accommodate multiple unit trains. In order to accommodate multiple trains, currently loop track designs must increase their size and extra trackage must be constructed just to avoid traffic conflicts between multiple trains. The extra trackage required is beyond the usual staging track typically constructed in conjunction with the loop track to stage trains awaiting loading or unloading, or awaiting a scheduled departure. That additional trackage requires additional investment in infrastructure such as real estate, site civil work, and construction of the track, as well as increased maintenances costs.

Furthermore, even if expanded or lengthened to accommodate multiple trains, current loop track designs typically do not allow trains to arrive or depart the facility, enter loading and unloading tracks, or to navigate through the facility independently of trains already at the facility, as the throat and crossover track arrangement necessitate that the trains cross each other's paths.

And, current loop track designs typically require the locomotives to be turned and repositioned from the head end of the train to the rear end of the train, which adds additional time to the operation, requires the construction of an additional wye track arrangement, and requires additional clear track to accommodate the locomotives being moved from one end of the train to the other.

With current unit train single track loop track designs, when more than one train is present on the loop track—e.g., when a first train is loading or unloading, and a second train arrives—the first train essentially blocks the second train from entering the loading or unloading track until the first train has completed its operation and departed. Thus, if there is any delay in loading or unloading the first train, the second train is likewise delayed and its arrival, loading or unloading operations block the main line track unless an extra staging track is constructed separate from the loop track for the sole purpose of accommodating the second train until it can cross the first train's path and enter the loop track used for loading or unloading.

Accommodations to the unit train loop track design to attempt to alleviate the problems as just discussed are not always possible. At many locations, such as at sea ports, there is a scarcity of real estate available to railroads to construct large footprint facilities, and even if available, the cost of such prime real estate is prohibitive. Thus, current loop designs are often insufficient to allow any efficiency improvement accommodations and the operation of the facility is often not economically viable.

Current unit train loop track designs isolate the space inside of the loop such that the space cannot be readily accessed or used for storage of commodities or other cargo. To avoid interfering with the loop track, access to the interior space requires construction of a road overpass to that interior space.

Thus, in the case of current loop track designs, the efficiency and throughput of commodities and cargo through a loading or unloading facility is inherently limited by the loop track design. Only if precision scheduling is achieved between the loading or unloading facility and the railroad, and only if unforeseeable delays can be avoided, can the loop track be operated at a reasonable efficiency rate with high volumes.

Railroad intermodal facilities are comprised of multiple tracks, including staging tracks for arriving and departing trains, and working tracks for loading and unloading trailers and containers, typically arranged parallel to the main line track, with the length of the track sufficient to accommodate an entire, intact, intermodal train.

In a typical facility, working and staging tracks are located side-by-side, next to the main line, and share the same lead track at each end. Lead tracks link the main line to each end of the intermodal staging and working tracks, allowing arriving and departing trains to transition from the main line directly to an intermodal working track for loading or unloading or directly to a staging track for later movement the intermodal working track.

Thus, in typical intermodal train operation, an arriving train track leaves the main track via the lead track and enters either the staging or working track. With a sufficiently sized intermodal track the entire train is contained on a single track.

In typical intermodal operations, the intermodal train is unloaded and loaded with equipment moving along the intermodal track. Upon completion of the loading or unloading the intermodal train departs the working track directly to the main line via the lead track, or is moved from the working track to a staging track via the lead track, later departing from the staging track to the main line via the lead track.

While current intermodal track designs generally serve their intended purpose of loading and unloading multiple intact intermodal train without inhibiting the main line, the current design is not without numerous drawbacks. For example, in order to accommodate the entire intermodal train on a working or staging track plus lead tracks connecting to the main line requires significant right-of-way parallel to the main line track unencumbered by at-grade crossings. Intermodal facilities serve multiple trains simultaneously. However, current intermodal track designs cannot efficiently accommodate multiple intermodal trains arriving, departing, or being moved between working tracks and staging tracks. In order to accommodate multiple trains, current intermodal track designs must increase the number of track leads and number of working tracks to reduce the number of train movements between the staging tracks and working tracks on the track leads which conflict with other intermodal trains arriving and departing. That additional trackage requires additional investment in infrastructure such as real estate, site civil work, and construction of the track, as well as increased maintenances costs.

Furthermore, even if expanded or lengthened to accommodate multiple trains, current intermodal track designs limit the number of trains allowed to arrive or depart the facility to either the working or staging tracks, or to navigate between staging and working tracks, as the lead track arrangement necessitate that the trains cross each other's paths.

With current intermodal track designs, when more than one train is present on the lead track—e.g., when a first train is arriving, departing, or moving between staging track and working track and a second train arrives—the first train essentially blocks the second train from entering the intermodal working or staging track until the first train has completed its operation of arriving, departing, or moving between working and staging tracks. Thus, if there is any delay in the first train the second train is likewise delayed and its arrival, loading, or unloading operations block the main line track unless an extra staging track is constructed outside the intermodal tracks for the sole purpose of accommodating the second train until it can cross the first train's path and enter a working or staging track.

Accommodations to the intermodal train track design to attempt to alleviate the problems as just discussed are not always possible. At many locations, there is a scarcity of real estate available to railroads which are long and parallel to the mainline track unencumbered by at-grade crossings to construct intermodal facilities, and even if available, the cost of such prime real estate and cost of necessary off-site improvements such as grade separations is prohibitive. Thus, current intermodal designs are often insufficient to allow any efficiency improvement accommodations and the operation of the facility is often not economically viable.

In view of the above, it can be seen that there remains a need in the art for a railroad track design for unit train and intermodal train loading and unloading facilities that accommodates multiple trains and allows a high throughput of trains and cargo.

SUMMARY OF THE INVENTION

Embodiments of the invention are defined by the claims below, not this summary. A high-level overview of various aspects of the invention is provided here to introduce a selection of concepts that are further described in the Detailed Description section below. This summary is not intended to identify key features or essential features of the claimed subject matter, nor is it intended to be used in isolation to determine the scope of the claimed subject matter. In brief, this disclosure describes, among other things, a railway facility with high throughput loop track and balloon track.

In one aspect, the outer loop staging tracks comprise a plurality of adjacent, generally concentric, tracks encircling an interior space. The staging tracks, connected via switches, are of sufficient length to hold an entire unit or intermodal train. Thus, every train entering the facility follows the same path from the main line into a staging track.

In another aspect, a balloon loop is positioned in the interior space, within the encircling staging tracks. The balloon loop extends along the interior side of the staging tracks along one end, and turns back through the interior space, forming an interior balloon loop within the outer staging tracks. For unit trains, the balloon loop thus provides a path that allows trains to turn completely during the loading and unloading process, thus avoiding the need to switch locomotives from one end of the train to the other as required in a conventional loop track design. For intermodal trains, the balloon loop provides a path that allows trains to move, intact, to working tracks, or to be split into multiple working tracks for unloading of containerized cargo without the need for long lead tracks. Furthermore, the design of the present invention is unencumbered by at-grade crossings and does not require the entire site to be long and narrow parallel to the main line, as is the case in conventional intermodal facility designs.

The combination of the outer loop staging tracks and the interior balloon loop effectively form an endless infinity loop design that allows multiple unit or intermodal trains to enter their respective facilities without conflicting with a separate unit train loading or unloading, or with other intermodal trains moving between staging and working tracks or departing.

Unit trains can thus be loaded or unloaded in succession, following the same path from the outer loop staging tracks onto the balloon loop, through the loading and unloading facility, and then either depart to the main line directly or return to the outer loop staging tracks for later departure, with no crossing of paths of the next train being loaded or unloaded.

Intermodal trains can be arrived following the same path from the main line into an outer loop staging track, then from the outer loop staging track onto the balloon loop onto intermodal working track(s) for loading and unloading of trailers and containers. When loading and unloading of trailers and containers is complete, the intermodal train then either departs to the main line directly or returns to the outer loop staging tracks for later departure with no crossing of paths with the next intermodal train being moved to the intermodal working track(s).

The balloon loop turns each train within the interior space so that each train is directed to the loading or unloading facility and is ready to depart after loading or unloading with no switching or turning of locomotives required. The train simply completes the loading or unloading and either re-enters a loop staging track for later departure or immediately and directly exits the facility via an escape track, discussed below.

In another aspect, the plurality of staging tracks are spaced apart at distances of approximately fifteen feet and twenty-five feet, the spacing alternating between adjacent staging tracks, so that inspection vehicles have access adjacent each of the multiple staging tracks.

In another aspect, a bad-order setout track, located at the exit end of the staging track is provided, allowing bad-order cars to be set out before train departure from any of the multiple staging tracks and allowing make-up cars to be added to restore outbound trains to full length.

In a further aspect an escape track is provided to allow trains that have completed the loading or unloading process to immediately depart the facility, or alternatively to move to one of the multiple staging tracks, either alternative accomplished without repositioning of locomotives.

In further aspects, the unit train railway facility with high throughput loop track of the present invention provides train-length capacity on the balloon tracks ahead of, or both ahead of and behind, the loading and unloading facility, trains can arrive and/or depart from the staging tracks independently of other trains being loaded or unloaded, while the staging tracks are used for both arriving and departing trains.

In a further aspect, additional staging tracks can be added to either the inside or outside of the concentric loop design with minimal impact to operations or additional infrastructure costs.

In another aspect, space within the interior of the loop staging tracks may be provided without a road overpass as is required in current loop track designs, to avoid blocking at-grade crossings as in conventional designs.

In another aspect, multiple interior balloon tracks may be employed to serve multiple loading and unloading facilities, sharing loop staging tracks without conflicting with other unit train loading, unloading, or arrival and departure.

In another aspect, lead tracks may be added to the interior of the staging loop tracks, parallel to the balloon tracks for independent transloading within the interior space of the balloon tracks without affecting the loading or unloading of trains positioned on the balloon loop track.

DESCRIPTION OF THE DRAWINGS

Illustrative embodiments of the invention are described in detail below with reference to the attached drawing figures, and wherein.

DETAILED DESCRIPTION

The subject matter of select embodiments of the invention is described with specificity herein to meet statutory requirements. But the description itself is not intended to necessarily limit the scope of claims. Rather, the claimed subject matter might be embodied in other ways to include different components, steps, or combinations thereof similar to the ones described in this document, in conjunction with other present or future technologies. Terms should not be interpreted as implying any particular order among or between various steps herein disclosed unless and except when the order of individual steps is explicitly described. The terms "about", "approximately", "generally", or other terms of approximation as used herein denote deviations from the exact value in the form of changes or deviations that are insignificant to the function.

Figure 1:
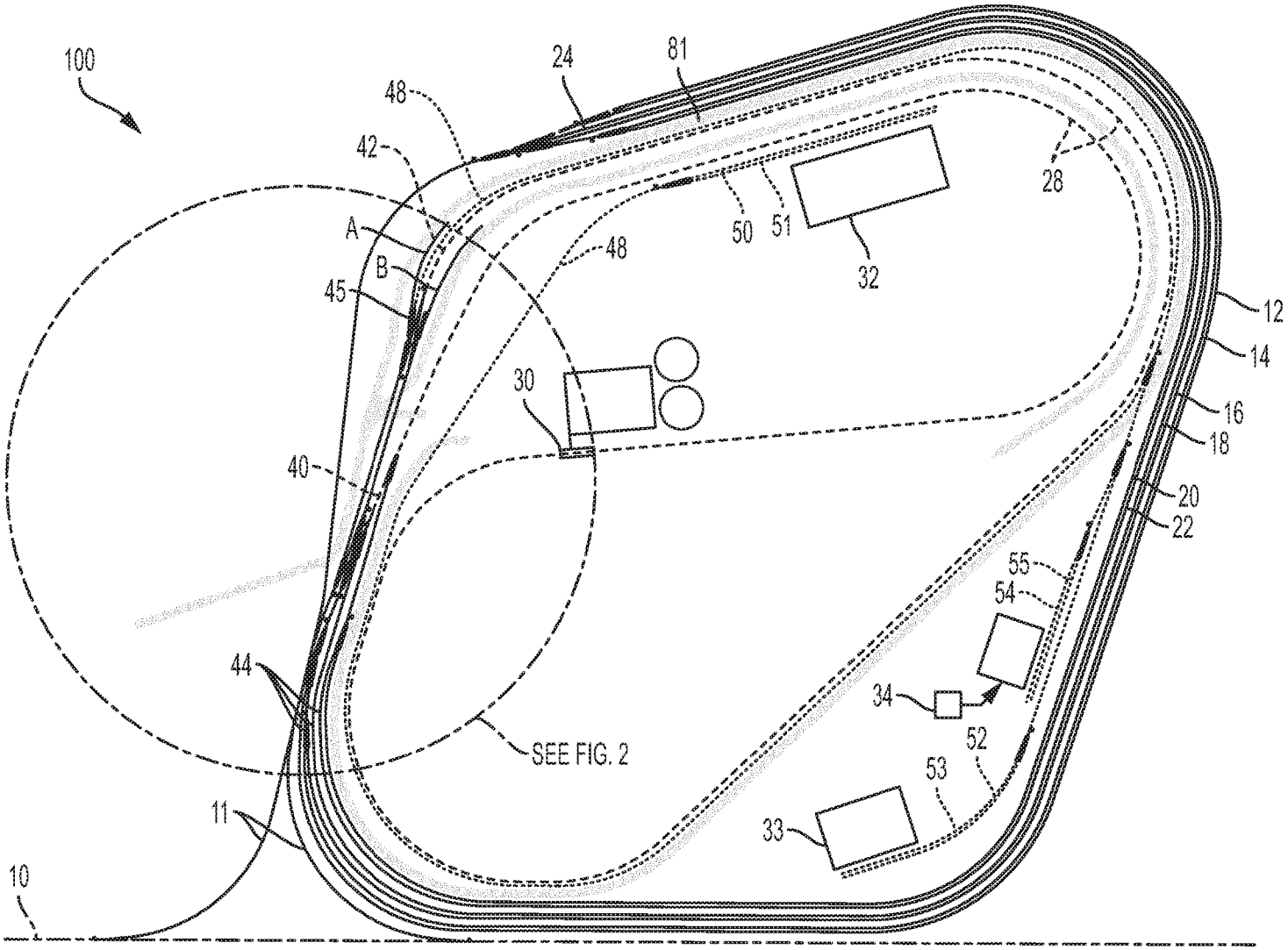
FIG. 1 is a plan view of a single unit train railway facility with high throughput loop track in accordance with a first exemplary embodiment of the present invention.
Figure 2:
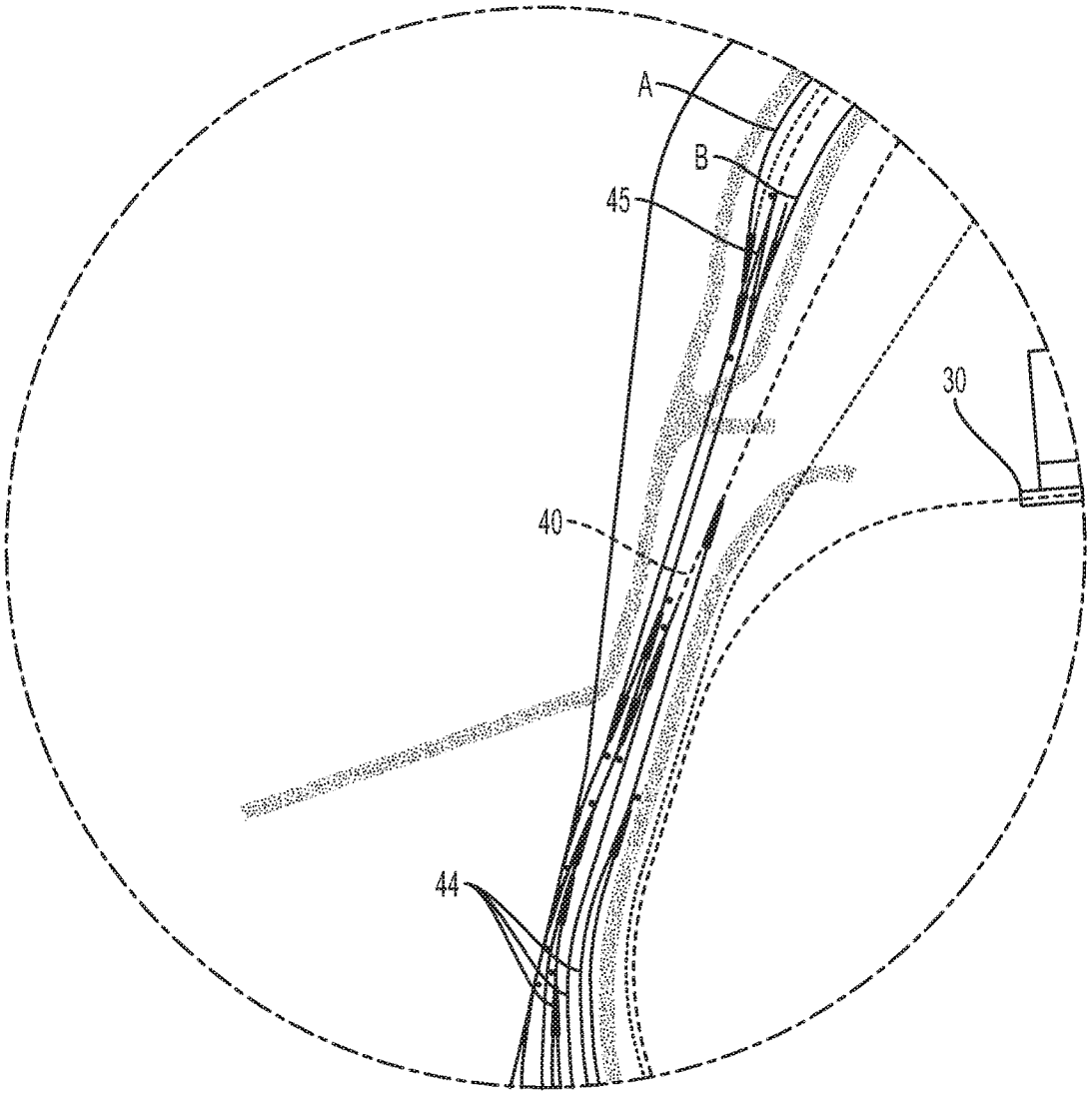
FIG. 2 is a close-up view of a first portion of the single unit train railway facility with high throughput loop track facility of FIG. 1, depicting a unique track configuration connecting each end of the staging, escape, and balloon tracks.
Figure 3:
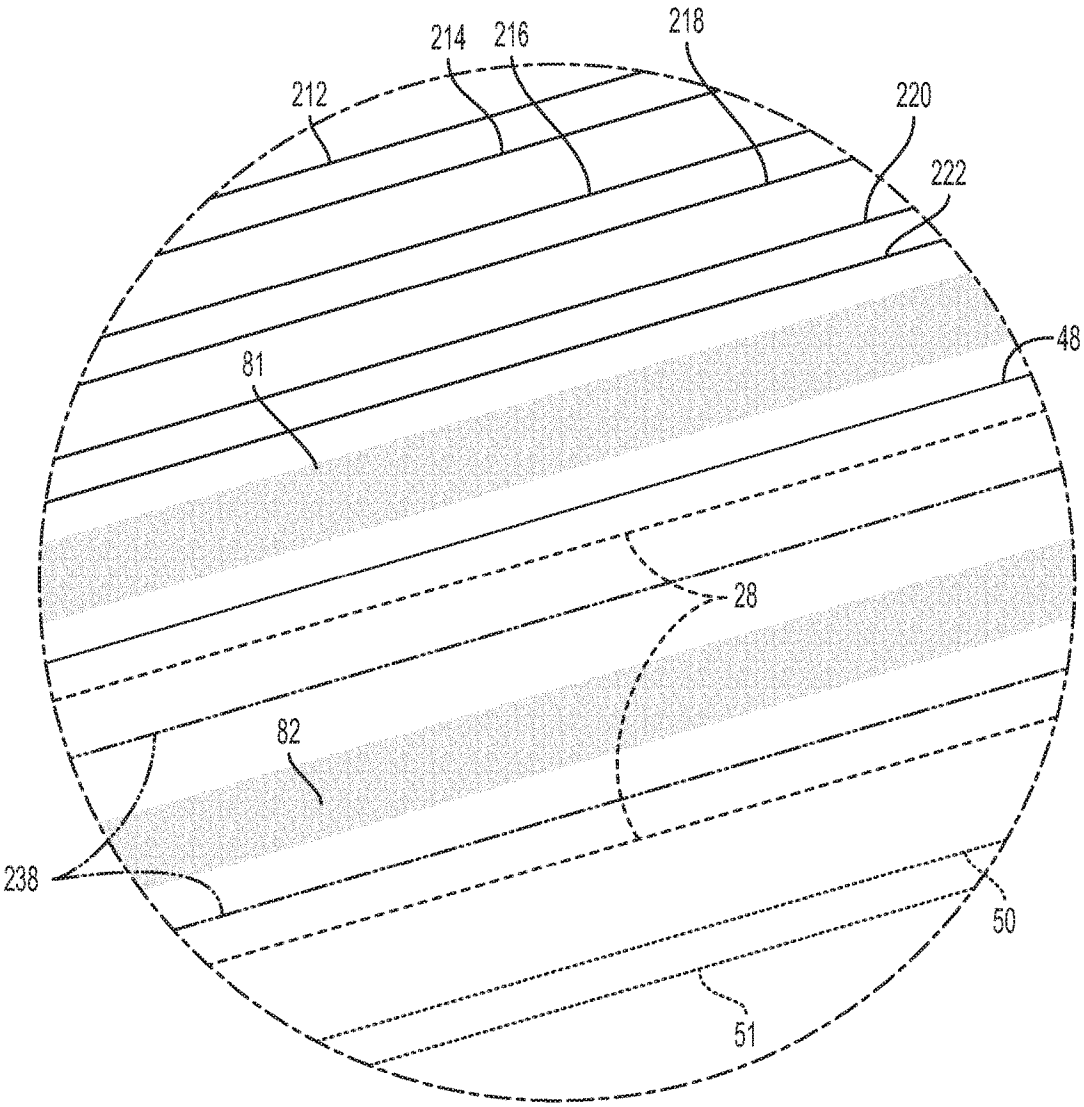
FIG. 3 is a close-up view of a second portion of the single unit railway facility with high throughput loop track of FIG. 4 depicting access roads to the interior of the loops tracks.

Looking first to FIGS. 1 and 2, a railway facility with high throughput loop track in accordance with a first exemplary embodiment of the present invention is designated by the reference numeral 100. The facility comprises six staging tracks 12, 14, 16, 18, 20, 22 encircling the outer perimeter of the facility, arranged generally concentrically in spaced-apart relationship, with staging track 12 the outermost and staging track 22 the innermost of the staging tracks.

The facility is preferably positioned in proximity to a railroad main line wye track 11 so that trains arriving at the facility enter the staging tracks 12, 14, 16, 18, 20, 22 from the main line 10 (from either direction) and trains departing the facility return to the main line 10 (to either direction). Preferably, the staging tracks are spaced apart at alternating fifteen foot and twenty-five foot distances so that a twenty-five foot spacing is available adjacent to at least one side of each staging track to allow access for an inspection vehicle (for pre-departure inspections). It should be understood that the six staging tracks 12, 14, 16, 18, 20, 22 depicted are for exemplary purposes, and that more or fewer staging tracks may be used in other embodiments of the present invention.

A plurality of turnouts 24 positioned at the end of the staging tracks 12, 14, 16, 18, 20, 22 allow arriving trains to be directed into one of the staging tracks. Thus, trains entering the facility typically are directed onto the one of the staging tracks 12, 14, 16, 18, 20, 22.

A plurality of turnouts 44 positioned along the staging tracks 12, 14, 16, 18, 20, 22 allow trains to be directed from one of the staging tracks to balloon track 28 though loop balloon entrance 40.

Looking still to FIG. 1, a balloon loop 28 extends around the interior perimeter of the plurality of concentric staging tracks 12, 14, 16, 18, 20, 22 adjacent the innermost staging track 22. The balloon loop 28 follows the interior perimeter of the staging track 22 along the bottom and right sides, but loops back and downward, forming an interior balloon loop within the facility. The balloon loop thus directs the train(s) to loading and unloading facilities 30 positioned on the interior perimeter of the staging tracks in the middle of the facility. The train, after being loaded or unloaded, exits balloon loop 42 and is directed to a plurality of turnouts 44 and 45 to reach the staging tracks 12, 14, 16, 18, 20, 22, thus allowing trains to be directed into one of the staging tracks for later departure. Preferably, the balloon track clear length beyond the loading and unloading facility is at least equal to the length of the longest train to be processed in order to use the escape track 26 to potentially directly depart rather than using a staging track to depart. Trains departing directly from the balloon track or being re-chambered in a staging track can use either bad order track A or bad order track B to set out railcars requiring repair. The loading and unloading facility 30 may be any such facility known in the art, such as facilities for loading and/or unloading bulk commodities.

Looking still to FIG. 1, transload or manifest trains (or cuts of cars) to be loaded or unloaded are directed, with locomotives shoving, from the staging tracks 12, 14, 16, 18, 20, 22 through a plurality of turnouts 44 and 45, or directly from main line 10, to track 48 and through a plurality of turnouts to any of three transload or manifest facilities 32, 33, 34. In the embodiment shown, transload or manifest facility 32 is served by tracks 50 and 51, transload or manifest facility 33 is served by tracks 52 and 53, and transload or manifest facility 34 is served by tracks 54 and 55.

Vehicles receiving or delivering cargo to or from the transload or manifest facilities 32, 33, and 34 access the facilities via access road 81. Cargo unloaded from transload or manifest facilities 32, 33, and 34 are located in the interior spaces of the loop, thus cargo can be unloaded from arriving trains and easily transferred to vehicles from the transload/manifest tracks 50, 51, 52, 53, 54, 55 for transport from the facility. Alternatively, the cargo may be moved and stored in the interior yard spaces. Likewise, cargo stored in the interior yard spaces can be loaded onto cars on the transload/manifest tracks 50, 51, 52, 53, 54, 55 and then be easily transferred to departing trains at the transload/manifest facilities 32, 33, or 34. Thus, the interior space within the staging tracks loops and the balloon loop can be utilized and accessed without requiring grade separated track crossings or impeding the uninterrupted process of loading or unloading trains through the bulk facility as is common in conventional railway facilities known in the art.

Figure 4:
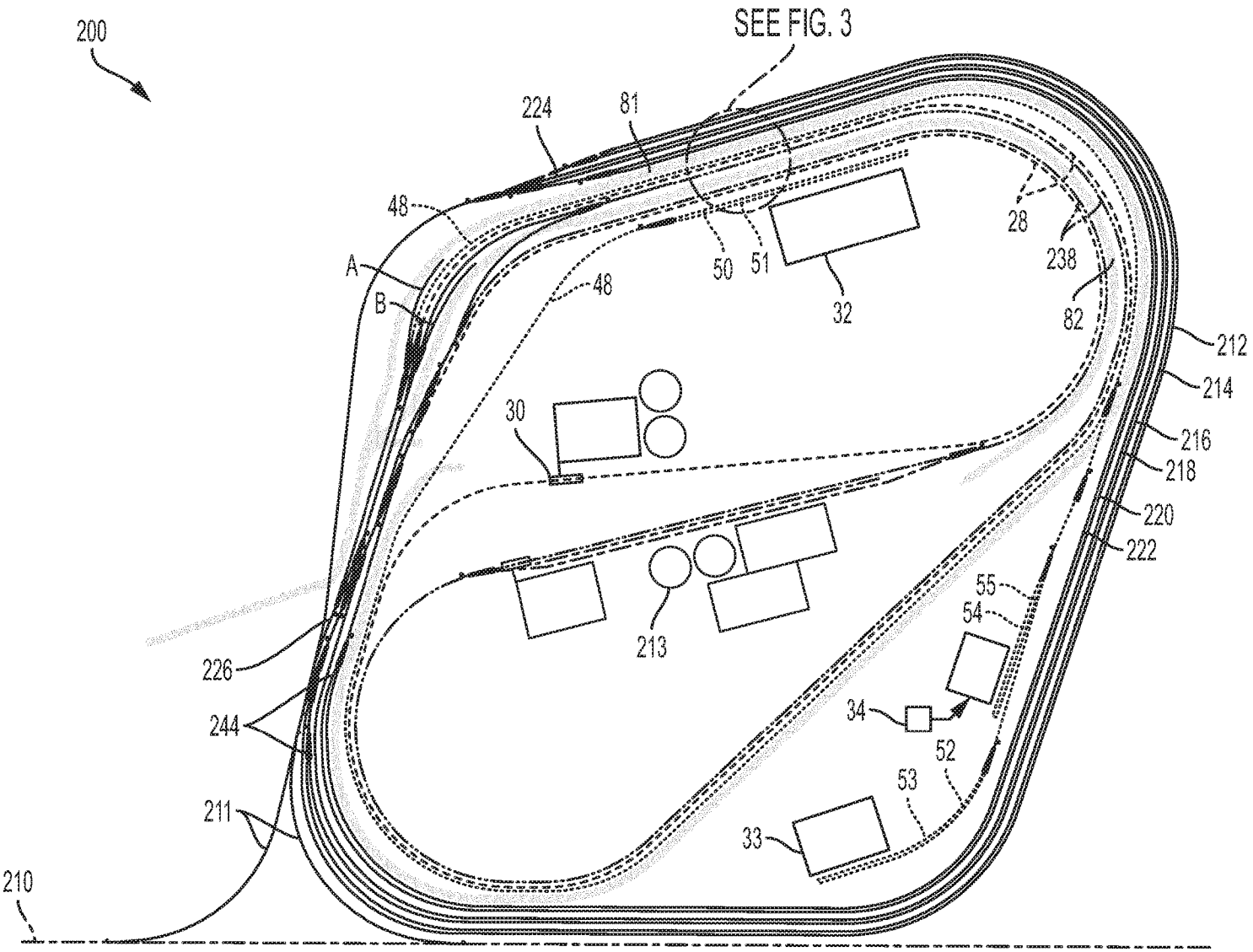
FIG. 4 is a plan view of a two unit train railway facility with high throughput loop tracks in accordance with a second exemplary embodiment of the present invention.
Figure 5A:
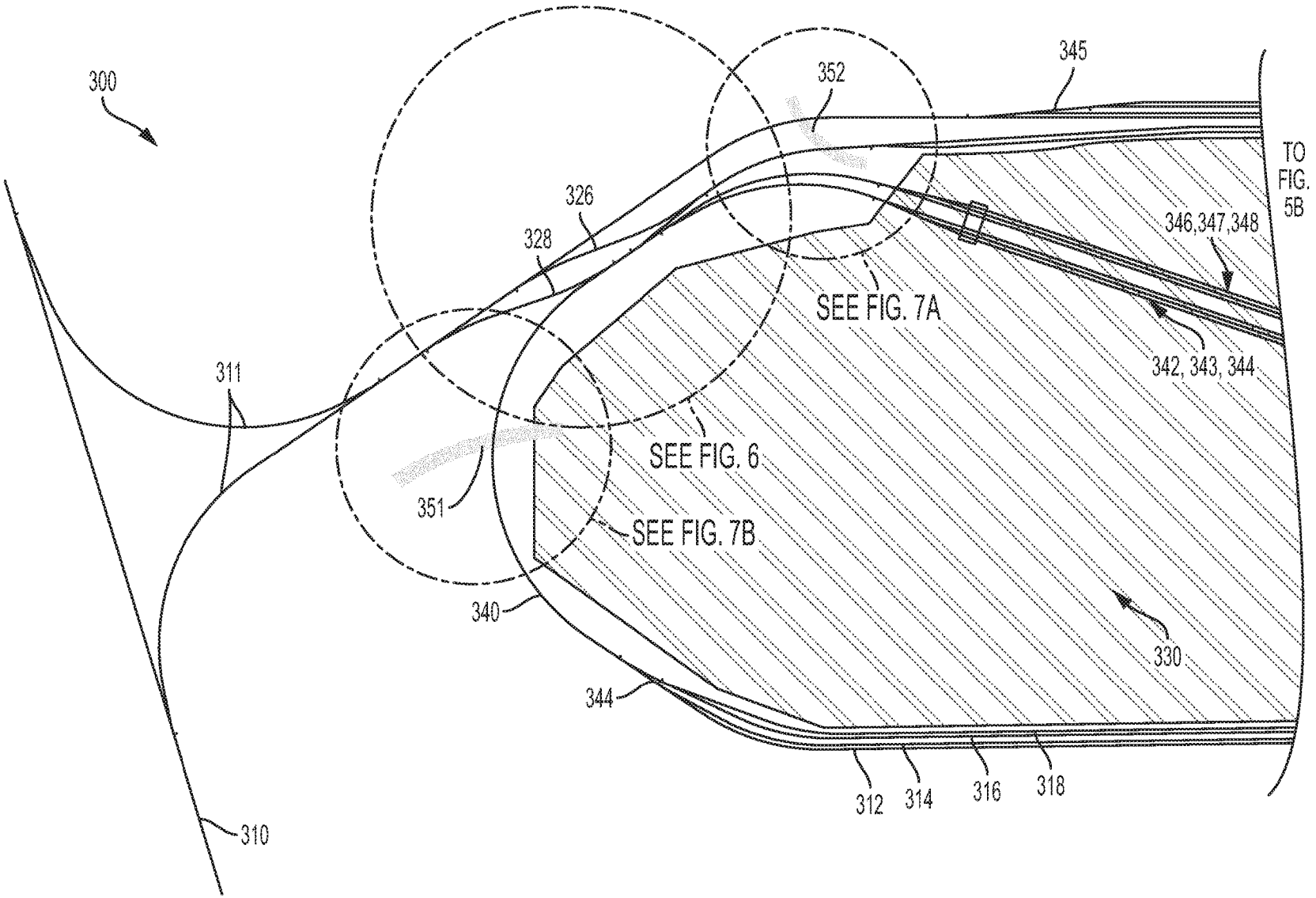
FIGS. 5A and 5B are a plan view of a small intermodal railway facility with high throughput loop track in accordance with a third exemplary embodiment of the present invention.
Figure 5B:
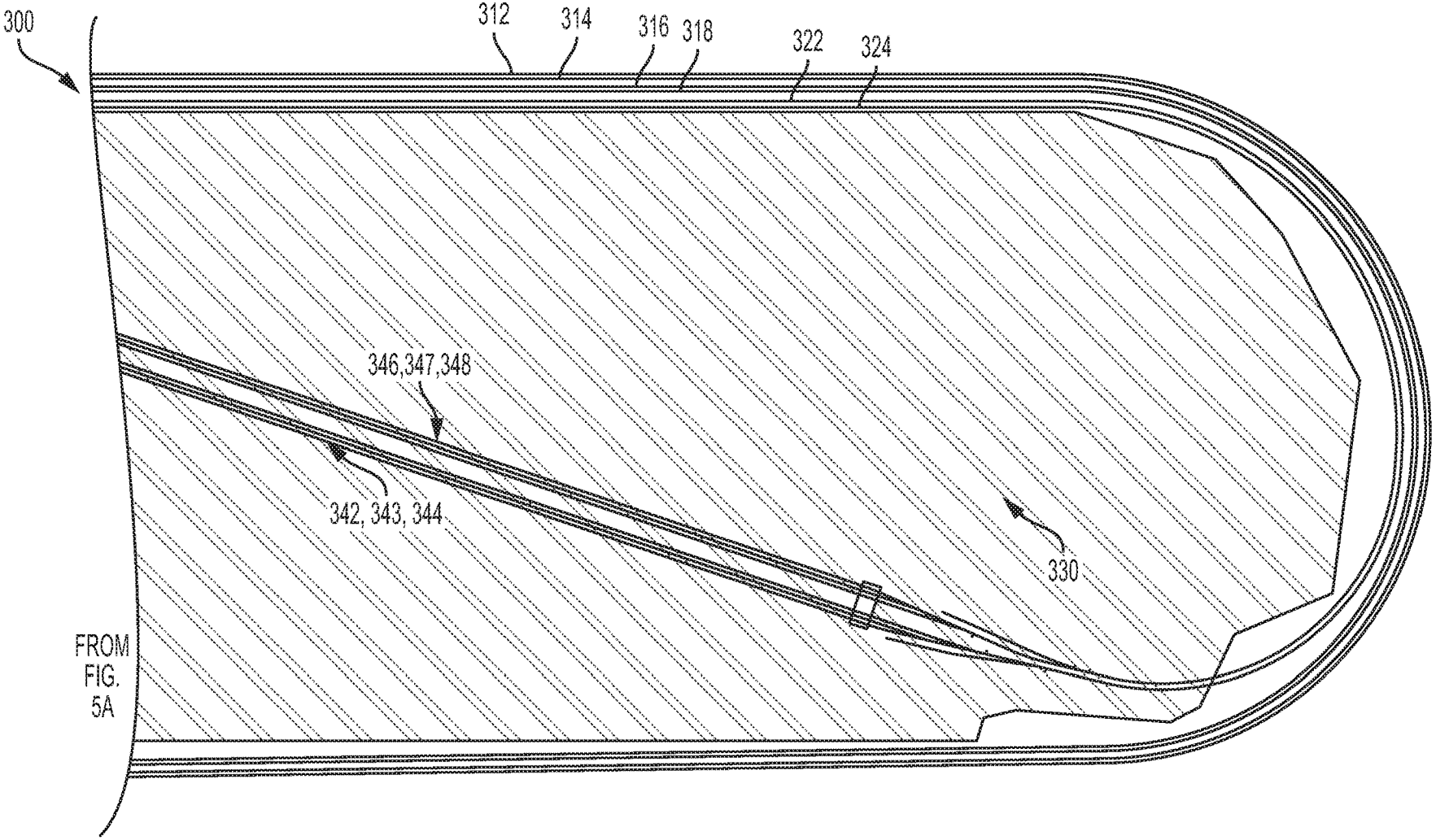
Figure 6:
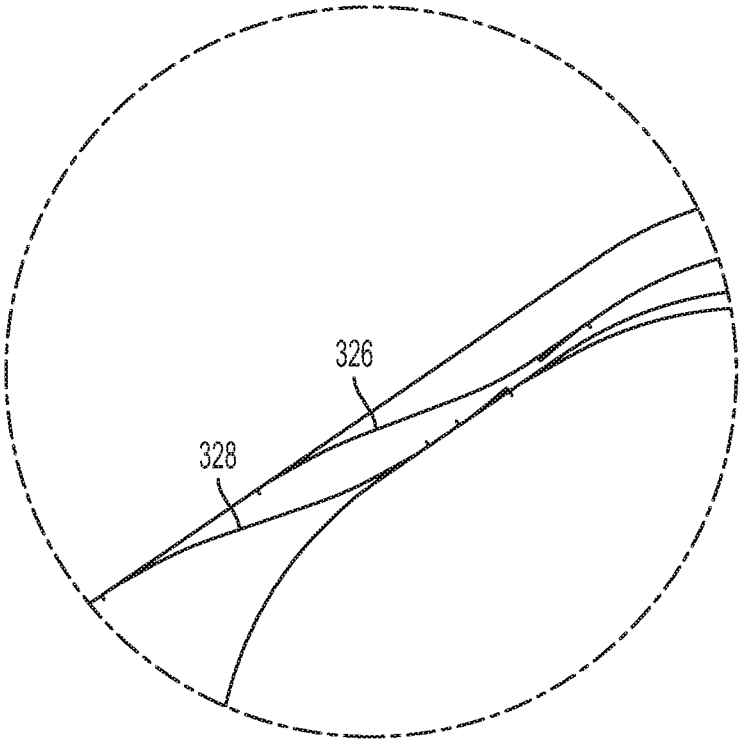
FIG. 6 is a close-up view of a first portion of the small intermodal railway facility with high throughput loop track of FIGS. 5A and 5B, depicting a unique track configuration connecting each end of staging, escape, direct entry, and balloon tracks.
Figure 7A:
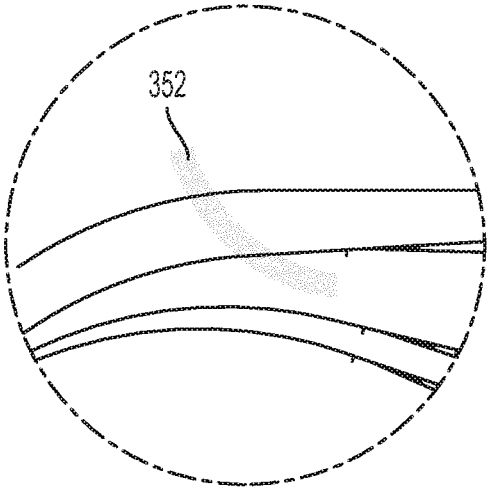
FIGS. 7A and 7B are close-up views of the small intermodal railway facility with high throughput loop track of FIGS. 5A and 5B depicting access roads to the interior of the loop tracks.
Figure 7B:
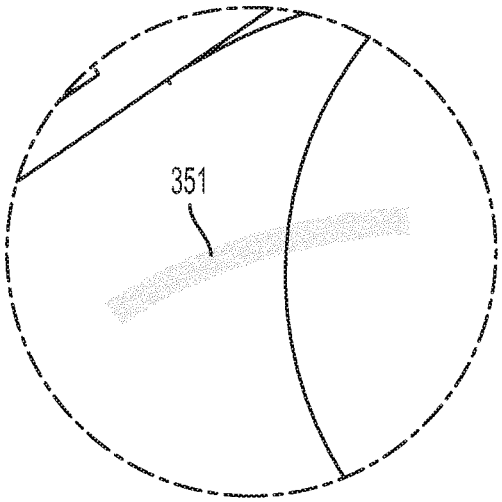

Turning to FIG. 4, a railway facility with inclusion of a second high throughput loop track in accordance with a second exemplary embodiment of the present invention is designated by the reference numeral 200. The facility comprises six staging tracks 212, 214, 216, 218, 220, 222 encircling the outer perimeter of the facility, arranged generally concentrically in spaced-apart relationship, with staging track 212 the outermost and staging track 222 the innermost of the staging tracks.

The facility is preferably positioned in proximity to a railroad main line wye track 211 so that trains arriving at the facility enter the staging tracks 212, 214, 216, 218, 220, 222 from the main line 210 and trains departing the facility return to the main line 210. Preferably, the staging tracks are spaced apart at alternating fifteen foot and twenty-five foot distances so that a twenty-five foot spacing is available adjacent to at least one side of each staging track to allow access for an inspection vehicle. It should be understood that the six staging tracks 212, 214, 216, 218, 220, 222 depicted are for exemplary purposes, and that more or fewer staging tracks may be used in other embodiments of the present invention.

A plurality of turnouts 224 positioned at the end of the staging tracks 212, 214, 216, 218, 220, 222 allow trains to be directed into one of the staging tracks. Thus, trains entering the facility typically are directed onto the one of the staging tracks 212, 214, 216, 218, 220, 222.

A plurality of turnouts 244 positioned along the staging tracks 212, 214, 216, 218, 220, 222 allow trains to be directed from one of the staging tracks to balloon track 238.

Looking still to FIG. 4, a balloon loop 238 extends around the interior perimeter of the plurality of concentric staging tracks 212, 214, 216, 218, 220, 222 adjacent the innermost staging track 222. The balloon loop 238 follows the interior perimeter of the staging track 222 along the bottom and right sides, but loops back and downward, forming an interior balloon loop within the facility. A plurality of turnouts 244 positioned along the staging tracks 212, 214, 216, 218, 220, 222 allow trains to be directed from one of the staging tracks to balloon track 238. The balloon loop thus directs the train(s) to a loading and unloading facilities 213 positioned on the interior perimeter of the staging tracks in the middle of the facility. Loading and unloading facility 213 may be configured for use with either a dry bulk unit train where the train remains intact, or a liquid bulk unit train where the train is loaded or unloaded on two separate tracks.

The train after being loaded or unloaded is directed to a plurality of turnouts 244 positioned at one end of the staging tracks 212, 214, 216, 218, 220, 222 allowing trains to be directed into one of the staging tracks for later departure. The balloon track clear length beyond the loading and unloading facility is preferably equal to or greater than the length of the longest train to be processed in order to use the "escape" track 226 to potentially directly depart rather than using a staging track to depart. Trains departing directly from the balloon track or being rechambered in a staging track can use either bad order track A or bad order track B to set out railcars requiring repair. The loading and unloading facility 213 may be any such facility known in the art, such as facilities for loading and unloading bulk commodities.

Turning now to FIGS. 5A, 5B, 6, 7A and 7B, a railway facility with high throughput smaller intermodal facility loop track in accordance with a third exemplary embodiment of the present invention is designated by the reference numeral 300. The facility comprises four staging tracks 312, 314, 316, 318 encircling the outer perimeter of the facility, arranged generally concentrically in spaced-apart relationship, with staging track 312 the outermost and staging track 318 the innermost of the staging tracks.

The facility is preferably positioned in proximity to a railroad wye track 311 so that trains arriving at the facility enter the staging tracks 312, 314, 316, 318 from the main line 310 and trains departing the facility return to the main line 310. Preferably, the staging tracks are spaced apart at alternating fifteen foot and twenty-five foot distances so that a twenty-five foot spacing is available adjacent to at least one side of each staging track to allow access for an inspection vehicle. It should be understood that the four staging tracks 312, 314, 316, 318 depicted are for exemplary purposes, and that more or fewer staging tracks may be used in other embodiments of the present invention.

The intermodal facility 330 is comprised of two groups of three loading/unloading tracks. Group 1 tracks 342, 343, 344, and group 2 tacks 346, 347, 348. Preferably, the intermodal tracks are of a length equal to or greater than the that of the longest trains to be processed. It should be understood that the six intermodal tracks 342, 343, 344, 345, 346, 347, 348 depicted are for exemplary purposes and that more or fewer staging tracks may be used in other embodiments of the present invention.

The balloon track 322 supports intermodal group 1 tracks 342, 343, 344 and balloon track 324 supports intermodal group 2 tracks 346, 347, 348. Balloon tracks 322 and 324 preferably have a clear length beyond the intermodal loading and unloading facilities 330 that is preferably equal to or greater than the longest train, less the shortest intermodal tracks they support, in order to use the "escape" track 326 to potentially directly depart rather than using a staging track to depart.

In a further aspect a direct entry track 328 is provided to allow trains to immediately arrive direct to the intermodal facility without first being directed to one of the staging tracks.

A plurality of turnouts 345 positioned along the staging tracks 312, 314, 316, 318 allow trains to be directed into one of the staging tracks. Thus, trains entering the facility are typically directed onto the one of the staging tracks 312, 314, 316, 318.

Another plurality of turnouts 344 positioned along the staging tracks 312, 314, 316, 318 allow trains to be directed from one of the staging tracks to the intermodal entrance 340 and to either intermodal facility 330 group 1 tracks 342, 343, 344 or group 2 tracks 346, 347, 348. Trains are preferably routed to move directly to the first intermodal facility 330 an onto one of the intermodal facility 330 group 1 tracks 343, 343, 344 or group 2 tracks 346, 347, 348. When the rear end of the train is in the clear of one of the intermodal facility 330 group 1 tracks or intermodal facility 330 group 2 tracks, the train will pull forward on balloon track 322, or 324, respectively, counterclockwise then reverse direction, spotting the remainder of the train into the other two intermodal tracks of that respective group.

Vehicles receiving or delivering containers to or from intermodal facility 330 access the facility via access roads 351 and 352.

Figure 8A:
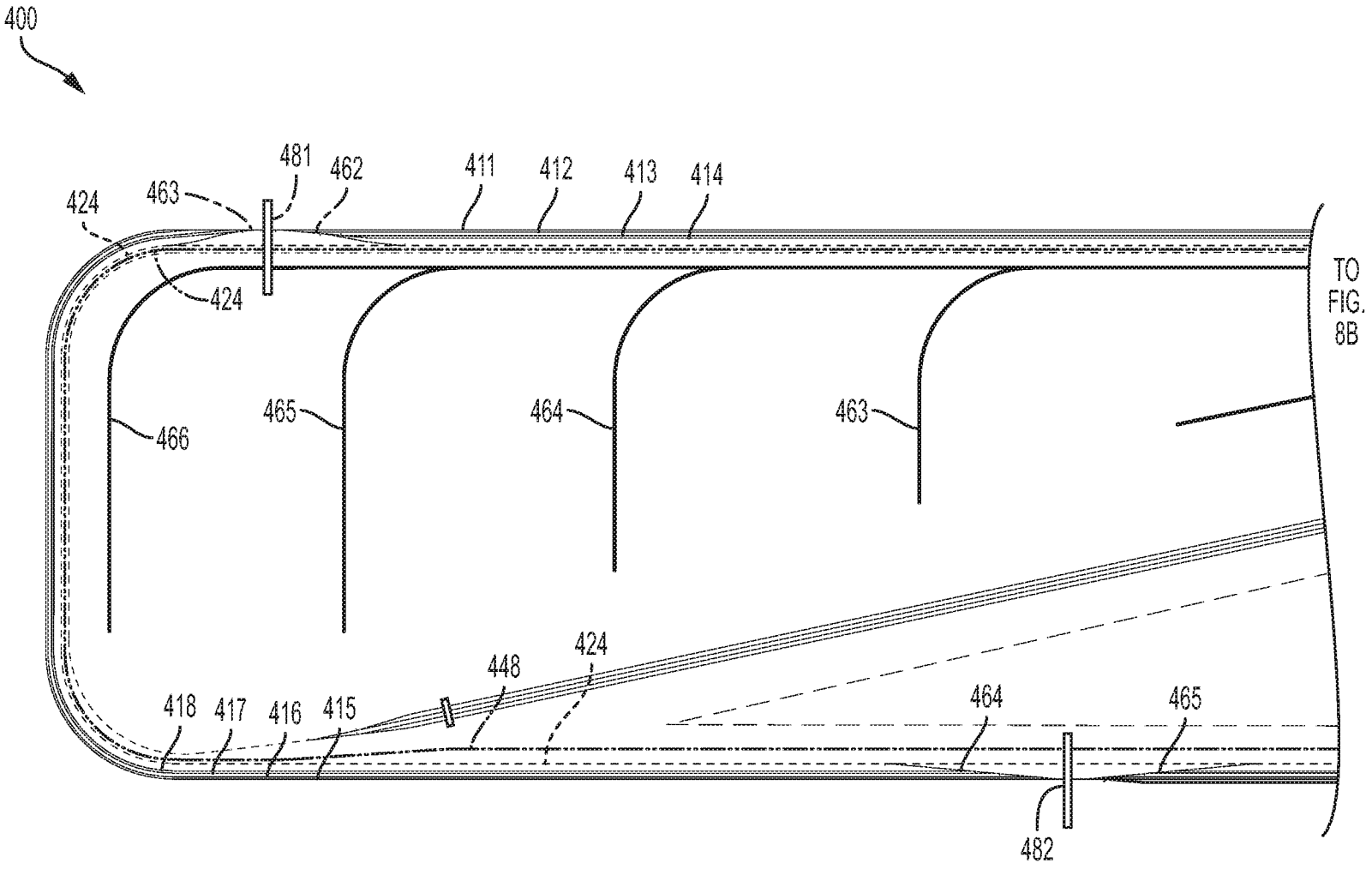
FIGS. 8A and 8B are a plan view of a large intermodal railway facility with high throughput loop track in accordance with a fourth exemplary embodiment of the present invention.
Figure 8B:
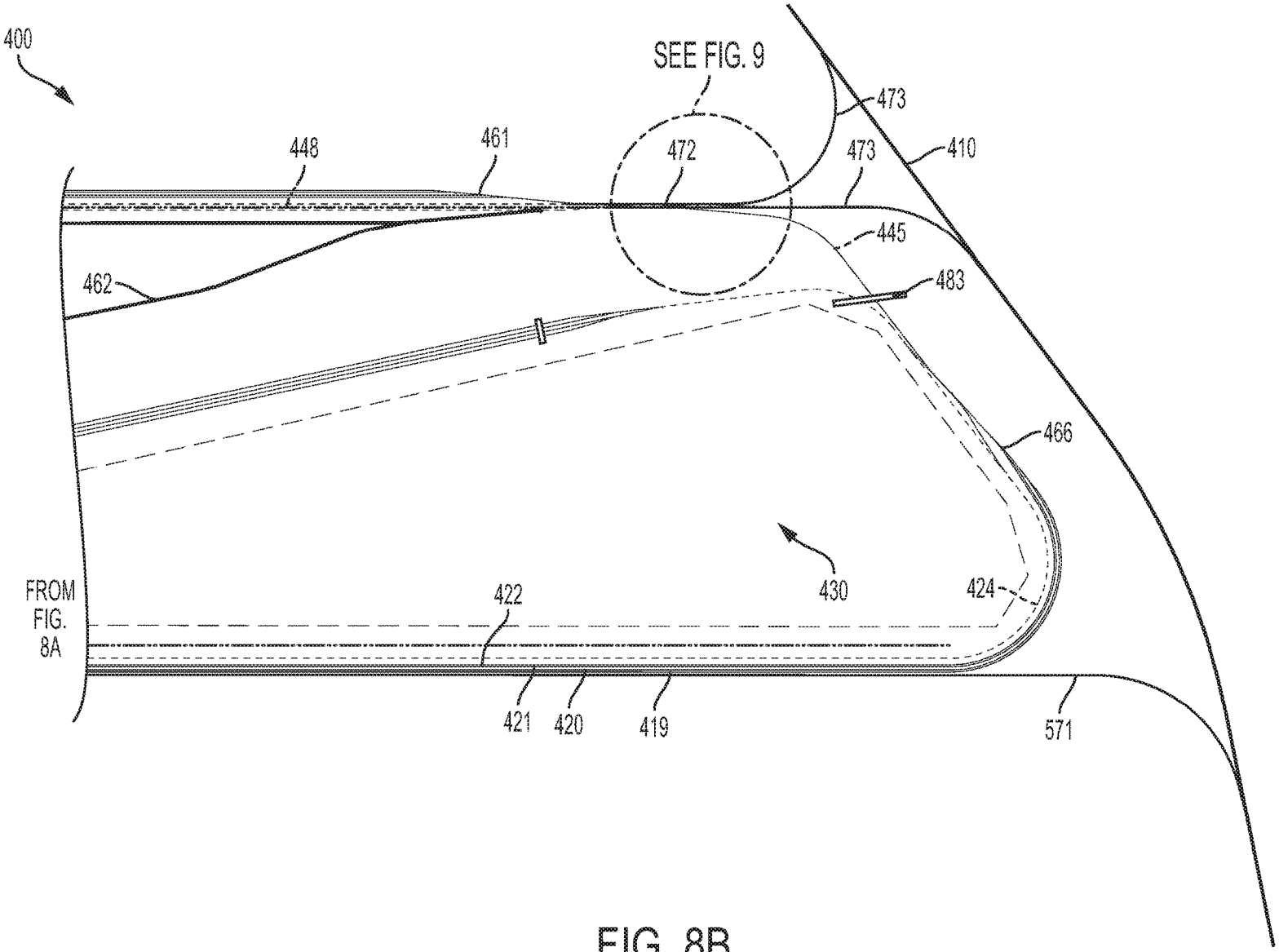

Turning to FIGS. 8A and 8B, a large intermodal railway facility with high throughput loop track in accordance with a fourth exemplary embodiment of the present invention is designated by the reference numeral 400. The facility comprises three groups of four staging tracks: group 1, comprising tracks 411, 412, 413, 414; group 2, comprising tracks 415, 416, 417, 418; and group 3, comprising tracks 419, 420, 421, 422; encircling the outer perimeter of the facility, arranged generally concentrically in spaced-apart relationship, with staging tracks 414, 418, 422 the innermost and staging track 411, 415, 419 the outermost of the staging tracks.

The facility is preferably positioned in proximity to a railroad main line wye track 473 such that trains arriving at the facility enter the staging tracks group 1 directly or, alternatively entering group 2 or group 3 via balloon track 424 from the main line 410 and trains departing the facility return to the main line 410. Preferably, the staging tracks are spaced apart at alternating fifteen foot and twenty-five foot distances so that a twenty-five foot spacing is available adjacent to at least one side of each staging track to allow access for an inspection vehicle. It should be understood that the twelve staging tracks (in the three groups identified above) are for exemplary purposes, and that more or fewer staging tracks may be used in other embodiments of the present invention. This embodiment also includes a lead track which allows for trains on the main line 410 to enter and exit the facility and be arrived, staged, and departed in group 1 and group 2 staging tracks without turning these trains though use of lead track 571.

In a further aspect an escape track 472 is provided to allow trains to immediately arrive direct to the intermodal facility without first being directed to one of the staging tracks.

A plurality of turnouts 461 allow trains to be directed into one of the group 1 staging tracks 411, 412, 413, 414. A plurality of turnouts 462 and 463 allow trains to be directed onto balloon track 424 and move counter clockwise to the intermodal facility 430.

Similarly, a plurality of turnouts 462 and 463 allow trains to be directed into one of the group 2 staging tracks 415, 416, 417. A plurality of turnouts 464 and 465 allow trains to be directed onto balloon track 424 and move counter clockwise to the intermodal facility 430.

And, a plurality of turnouts 464 and 465 to allow trains to be directed into one of the group 3 staging tracks 419, 420, 421, 422. A plurality of turnouts 466 allow trains to be directed onto balloon Track 424 and move counter clockwise to the intermodal facility 430.

Vehicles receiving or delivering containers to or from intermodal facility 430 access the facility via access roads 482 and 483.

Looking still to FIGS. 8A and 8B, a track 448 extends around the interior perimeter of the plurality of concentric staging tracks adjacent to track 424. This track thus directs the train(s) from track 473 or from a plurality of the staging tracks to the intermodal facility 430 positioned on the interior perimeter of the staging tracks in the south half of the facility for transloading operations.

The transload train, after being loaded or unloaded, is directed from track 448 and either departs on an escape track 472 and 473 to track 410, or to track 445 and through a plurality of turnouts 466 allowing trains to be directed into one of the staging tracks for later departure.

Figure 9:
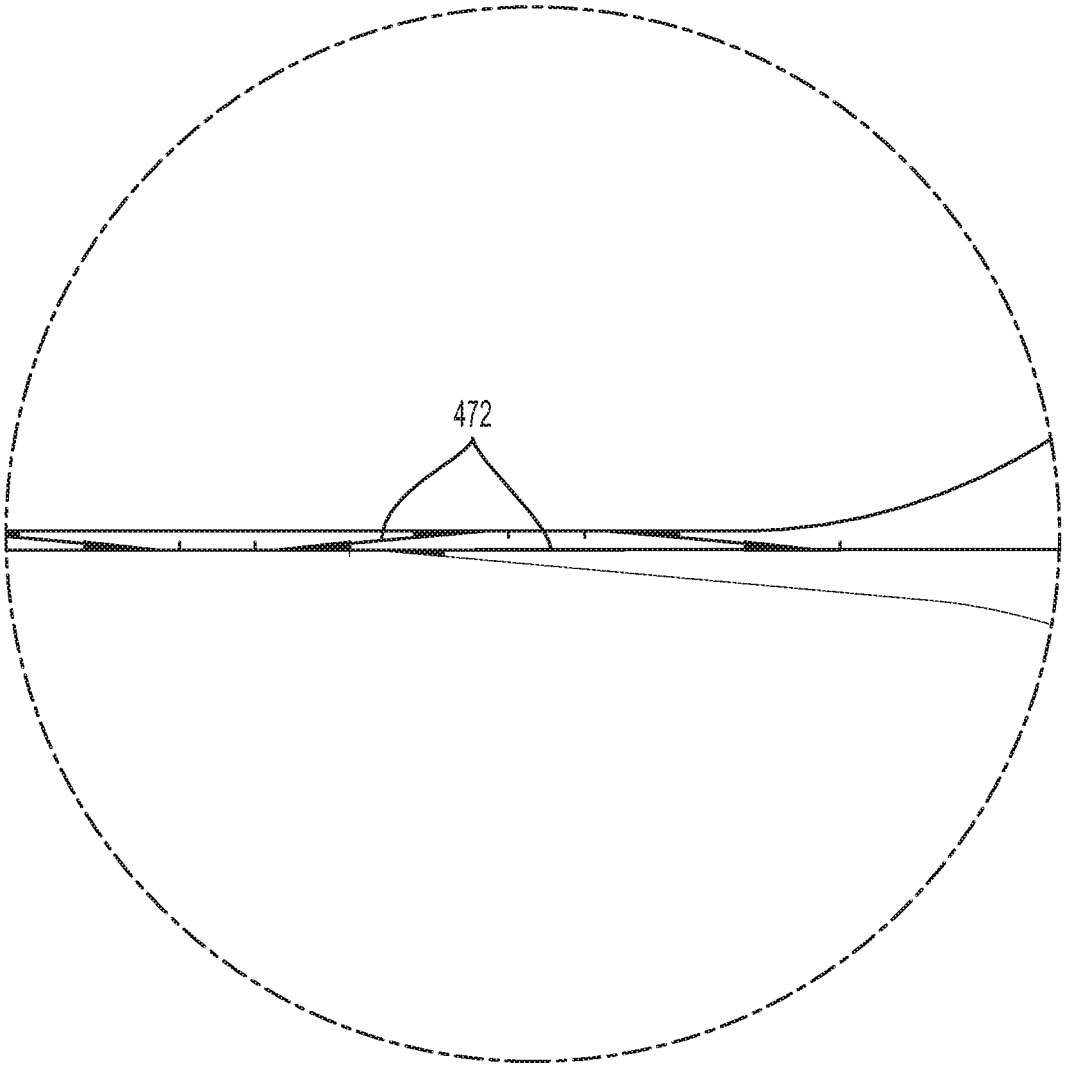
FIG. 9 is a close-up view of a turnout track portion of the large intermodal railway facility with high throughput loop track of FIGS. 8A and 8B.

The turnout arrangements along escape track 472 are best seen in FIG. 9.

Manifest trains (or cuts of cars) to be loaded or unloaded are directed from main line 410 to staging tracks in a manner to that previously described. Transload trains (or cuts of cars) to be loaded or unloaded are directed, with locomotives shoving from the staging track to track 445 to manifest facilities 462, 463, 464, 465, 466. Vehicles receiving or delivering cargo to or from the manifest facilities 462, 463, 464, 465, 466 access the facilities via access road 481. Cargo unloaded from manifest facilities 462, 463, 464, 465, 466 are located in the interior spaces of the loop and balloon cargo can be unloaded from arriving trains and easily transferred to vehicles from the manifest facilities 462, 463, 464, 465, 466 tracks and transported from the facility. Alternatively, cargo may be moved into and stored in the interior yard spaces. Likewise, cargo stored in the interior yard spaces can be loaded onto cars on the manifest tracks and then easily be transferred to departing trains at the manifest facilities 462, 463, 464, 465, 466. Thus, the interior space within the staging tracks loops and the balloon loop can be utilized and accessed without requiring grade separated track crossings or impeding the flow of trains through the intermodal working tracks of the facility as is the case in facilities known in the art.

While the present invention has been described herein with respect to exemplary embodiments of a railway facility with high throughput loop track, it should be understood that variations of those embodiments are likewise within the scope of the present invention. For example, while the exemplary embodiments depict three groups of four staging tracks, more or fewer staging tracks may be used within the scope of the present invention. Likewise, while the exemplary embodiments depict various combinations of features, not all of those features need be present in embodiments covered by the present invention. For example, the exemplary embodiments depict transload tracks and an escape track, either, both, or none of those features may be included in embodiments covered by this invention.

Many different arrangements of the various components depicted, as well as components not shown, are possible without departing from the scope of the claims below. Embodiments of the technology have been described with the intent to be illustrative rather than restrictive. Alternative embodiments will become apparent to readers of this disclosure after and because of reading it. Alternative means of implementing the aforementioned can be completed without departing from the scope of the claims below. Identification of structures as being configured to perform a particular function in this disclosure and in the claims below is intended to be inclusive of structures and arrangements or designs thereof that are within the scope of this disclosure and readily identifiable by one of skill in the art and that can perform the particular function in a similar way. Certain features and sub-combinations are of utility and may be employed without reference to other features and sub-combinations and are contemplated within the scope of the claims.

What is claimed is:

1. A railway facility with high throughput loop track, comprising:

a plurality of generally concentric staging tracks connected to at least one main line to receive arriving trains and to depart departing trains, wherein each of said plurality of staging tracks extends contiguously to substantially encircle an outer perimeter of the railway facility and wherein each of said plurality of staging tracks is connected to an adjacent one of said plurality of staging tracks such that the plurality of staging tracks forms a spiral track substantially encircling the railway facility path for directing a train around the railway facility; and a first balloon loop track connected to at least one of the plurality of staging tracks and positioned within a space defined within the concentric staging tracks, wherein the first balloon track extends contiguously around at least a portion of an interior perimeter of the plurality of generally concentric plurality of staging tracks, and wherein the first balloon loop track is configured to reverse the direction of a train with respect to the direction of the train through the spiral path of the staging tracks.

2. The railway facility with high throughput loop track of claim 1, wherein adjacent pairs of the plurality of concentric staging tracks are positioned in spaced apart relationship with respect to each other at distances of approximately fifteen feet and twenty-five feet alternating between respective pairs of staging tracks.

3. The railway facility with high throughput loop track of claim 1, further comprising a loading or unloading facility positioned in proximity to the first balloon loop such that a length of track greater than or equal to a length of a full train is provided on the first balloon loop track beyond the loading or unloading facility such that an entire full train can be serviced by the loading or unloading facility while on the first balloon loop track.

4. The railway facility with high throughput loop track of claim 1, further comprising at least one transload track connected to at least one of the staging tracks and running adjacent to the first balloon loop track, the transload track further extending into the space defined within the staging tracks and or the balloon loop to allow loading and unloading cargo into the interior space without interference with loading or unloading operations on the first balloon loop track.

5. The railway facility with high throughput loop track of claim 1, further comprising a second balloon loop track connected to at least one of the plurality of staging tracks and positioned within a space defined within the concentric staging tracks.

6. A railway facility with high throughput loop track, comprising:

at least one staging track connected to at least one main line to receive arriving trains and to depart departing trains, wherein the at least one staging track is configured to extend contiguously to substantially encircle an outer perimeter of the railway facility to receive an entire unit train and is arranged to direct a train around the outer perimeter of the railway facility; and a balloon loop connected to the at least one staging track and positioned within a space defined within the staging track, wherein the balloon track extends contiguously around at least a portion of an interior perimeter of the staging track, and wherein the balloon loop is configured to reverse the direction of a train with respect to the direction of an arriving train through the path of the staging track.

7. The railway facility with high throughput loop track of claim 6, wherein the at least one staging track comprises a plurality of staging tracks connected to the balloon loop track to allow the staging tracks to be used for staging both arriving and departing trains.

8. The railway facility with high throughput loop track of claim 7, wherein the plurality of staging tracks are arranged generally concentrically and run in adjacent relationship.

9. The railway facility with high throughput loop track of claim 8, wherein roadway access to the interior of the loop staging tracks and the interior of the balloon loop is provided via at-grade crossings which are not blocked by loading or unloading trains.

10. A railway facility with high throughput loop track, comprising:

a plurality of generally concentric staging tracks connected to at least one main line to receive at least first and second arriving unit trains and to depart the first and second unit trains, wherein each of said plurality of staging tracks extends contiguously to substantially encircle an outer perimeter of the railway facility and wherein each of said plurality of staging tracks is connected to an adjacent one of said plurality of staging tracks such that the plurality of staging tracks forms a spiral track path for directing a train around the railway facility; and a balloon loop track connected to at least one of the plurality of staging tracks and positioned within a space defined within the concentric staging tracks, wherein the balloon track extends contiguously around at least a portion of an interior perimeter of the plurality of generally concentric plurality of staging tracks, such that the track configuration permits the second train to enter the balloon loop as the first train departs or rechambers to an outer staging track without interference between paths of the two unit trains.

11. The railway facility with high throughput loop track of claim 10, wherein adjacent pairs of the plurality of concentric staging tracks are positioned in spaced apart relationship with respect to each other at distances of approximately fifteen feet and twenty-five feet alternating between respective pairs of staging tracks.

12. The railway facility with high throughput loop track of claim 10, further comprising a loading or unloading facility positioned in proximity to the balloon loop such that a length of track greater than or equal to a length of a full train is provided on the first balloon loop track beyond the loading or unloading facility such that an entire full train can be serviced by the loading or unloading facility while on the balloon loop track.

13. The railway facility with high throughput loop track of claim 10, further comprising at least one transload track connected to at least one of the staging tracks and running adjacent to the balloon loop track, the transload track further extending into the space defined within the staging tracks and or the balloon loop to allow loading and unloading cargo into the interior space without interference with loading or unloading operations on the balloon loop track.

* * * * *